US005231376A

United States Patent [19]

Arcarese

[11] Patent Number: 5,231,376

[45] Date of Patent: Jul. 27, 1993

[54] TOOL TRANSPORT CONTAINER APPARATUS

[76] Inventor: Frank V. Arcarese, 117 Florence Ave., Trenton, N.J. 08618

[21] Appl. No.: 846,029

[22] Filed: Mar. 5, 1992

[51] Int. Cl.[5] ..... G08B 13/14; H01H 35/02; A45F 3/02

[52] U.S. Cl. ..... 340/571; 200/61.47; 220/529; 224/202

[58] Field of Search ..... 340/571, 689; 200/61.47; 224/202, 209; 220/500, 527-529, 400, 319, 306; 206/373

[56] References Cited

U.S. PATENT DOCUMENTS

| | | | |
|---|---|---|---|
| 2,169,080 | 8/1939 | Clark | 224/209 |
| 3,812,997 | 5/1974 | McNally | 220/529 |
| 4,004,710 | 1/1977 | Crisci | 220/306 |
| 4,485,276 | 11/1984 | Sato | 224/209 |
| 4,826,007 | 5/1989 | Skeie | 206/373 |
| 4,993,551 | 2/1991 | Lindsay | 220/500 X |
| 5,041,815 | 8/1991 | Newton | 340/571 X |

*Primary Examiner*—Jin F. Ng
*Assistant Examiner*—Thomas J. Mullen, Jr.
*Attorney, Agent, or Firm*—Leon Gilden

[57] ABSTRACT

A tool transport container including a flexible carrying strap is provided, with the container including a divided container wall therewithin. The container wall is arranged to mount a compartmented further container, as well as a motion sensor to prevent inadvertent displacement of the organization by an unauthorized individual. The lid permits reception in a complementary manner of a further of the containers for a stacked relationship.

6 Claims, 4 Drawing Sheets

FIG. 8
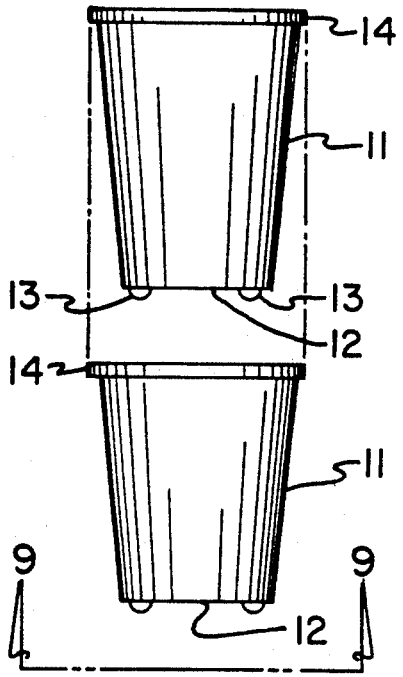
FIG. 9
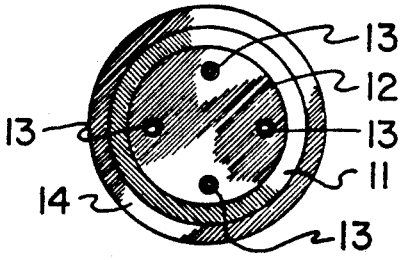
FIG. 10
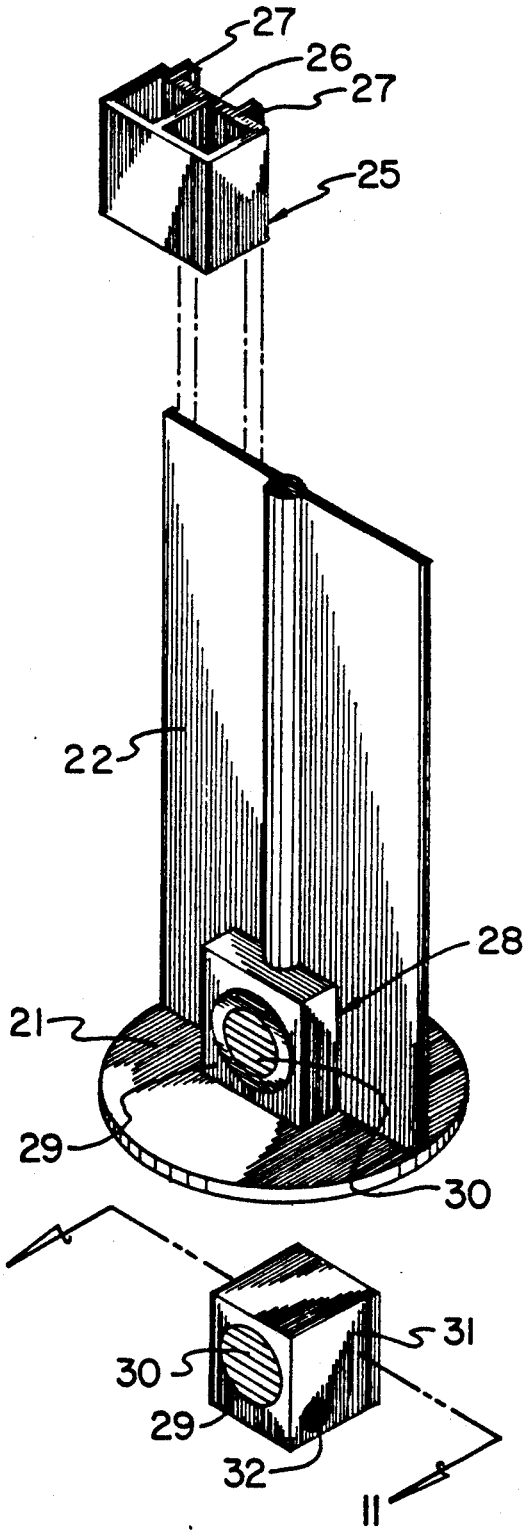
FIG. 10A
FIG. 11
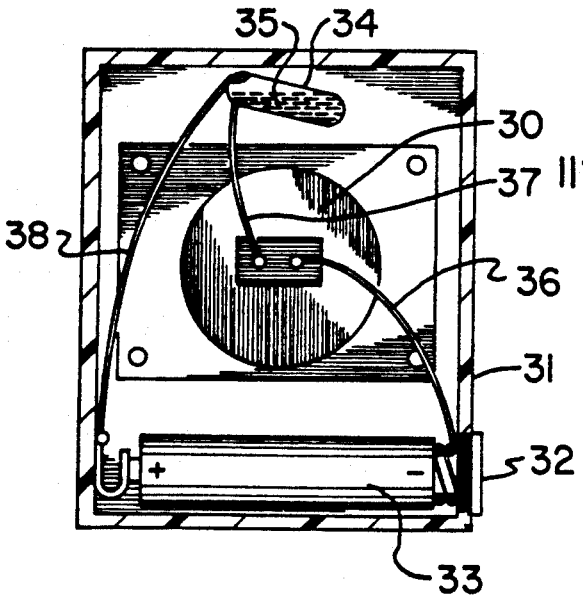

TOOL TRANSPORT CONTAINER APPARATUS

BACKGROUND OF THE INVENTION

1. Field of the Invention

The field of invention relates to container apparatus, and more particularly pertains to a new and improved tool transport container apparatus wherein the same permits the ease of transport, as well as the security of an alarm system associated with an unauthorized displacement of the organization.

2. Description of the Prior Art

Mechanics and the like are required to manipulate and transport various tool components and utilization of apparatus for the storage of tools and the like. The instant invention attempts to provide for a container arranged for ease of manipulation and transport to permit the positioning of the organization relative to a hip portion during transport of the container permitting case of climbing and movement during support of the container. While prior art container structure arranged for torso support has been utilized, the prior art has heretofore not provided for a container member arranged for the use by mechanics and the like of such devices wherein for example U.S. Pat. No. 4,561,576 to Lowe, et al. sets forth a video equipment bag structure arranged for torso support.

U.S. Pat. No. 4,815,640 to Johnson sets forth a flexible utility bag arranged for shoulder transport.

U.S. Pat. No. 4,336,899 to Price sets forth a carrying sling of a generally cylindrical configuration.

U.S. Pat. No. 4,874,119 to Winter sets forth a tool pack apparatus wherein a compartmented bag-like structure has various chambers therewithin for transport of tool components.

As such, it may be appreciated that there continues to be a need for a new and improved tool transport container apparatus as set forth by the instant invention which addresses the problems of ease of use as well as effectiveness in construction and in this respect, the present invention substantially fulfills this need.

SUMMARY OF THE INVENTION

In view of the foregoing disadvantages inherent in the known types of container apparatus now present in the prior art, the present invention provides a tool transport container apparatus wherein the same provides for the ease of manipulation and transport of the container and associated components therewithin. As such, the general purpose of the present invention, which will be described subsequently in greater detail, is to provide a new and improved tool transport container apparatus which has all the advantages of the prior art container apparatus and none of the disadvantages.

To attain this, the present invention provides a tool transport container including a flexible carrying strap, with the container including a divided container wall therewithin. The container wall is arranged to mount a compartmented further container, as well as a motion sensor to prevent inadvertent displacement of the organization by an unauthorized individual. The lid permits reception in a complementary manner of a further of said containers for a stacked relationship.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tool transport container apparatus which has all the advantages of the prior art container apparatus and none of the disadvantages.

It is another object of the present invention to provide a new and improved tool transport container apparatus which may be easily and efficiently manufactured and marketed.

It is a further object of the present invention to provide a new and improved tool transport container apparatus which is of a durable and reliable construction.

An even further object of the present invention is to provide a new and improved tool transport container apparatus which is susceptible of a low cost of manufacture with regard to both materials and labor, and which accordingly is then susceptible of low prices of sale to the consuming public, thereby making such tool transport container apparatus economically available to the buying public.

Still yet another object of the present invention is to provide a new and improved tool transport container apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an orthographic view, taken in elevation, of a plurality of containers in a stacked relationship.

FIG. 9 is an orthographic view, taken along the lines 9—9 of FIG. 8 in the direction indicated by the arrows.

FIG. 10 is an isometric illustration of the container divider wall structure utilizing accessory container positioned thereon.

FIG. 10*a* is an isometric illustration of the motion detector utilized by the invention.

FIG. 11 is an orthographic view, taken along the lines 11—11 of FIG. 10*a* in the direction indicated by the arrows.

DESCRIPTION OF THE PREFERRED EMBODIMENT

Figure 1:
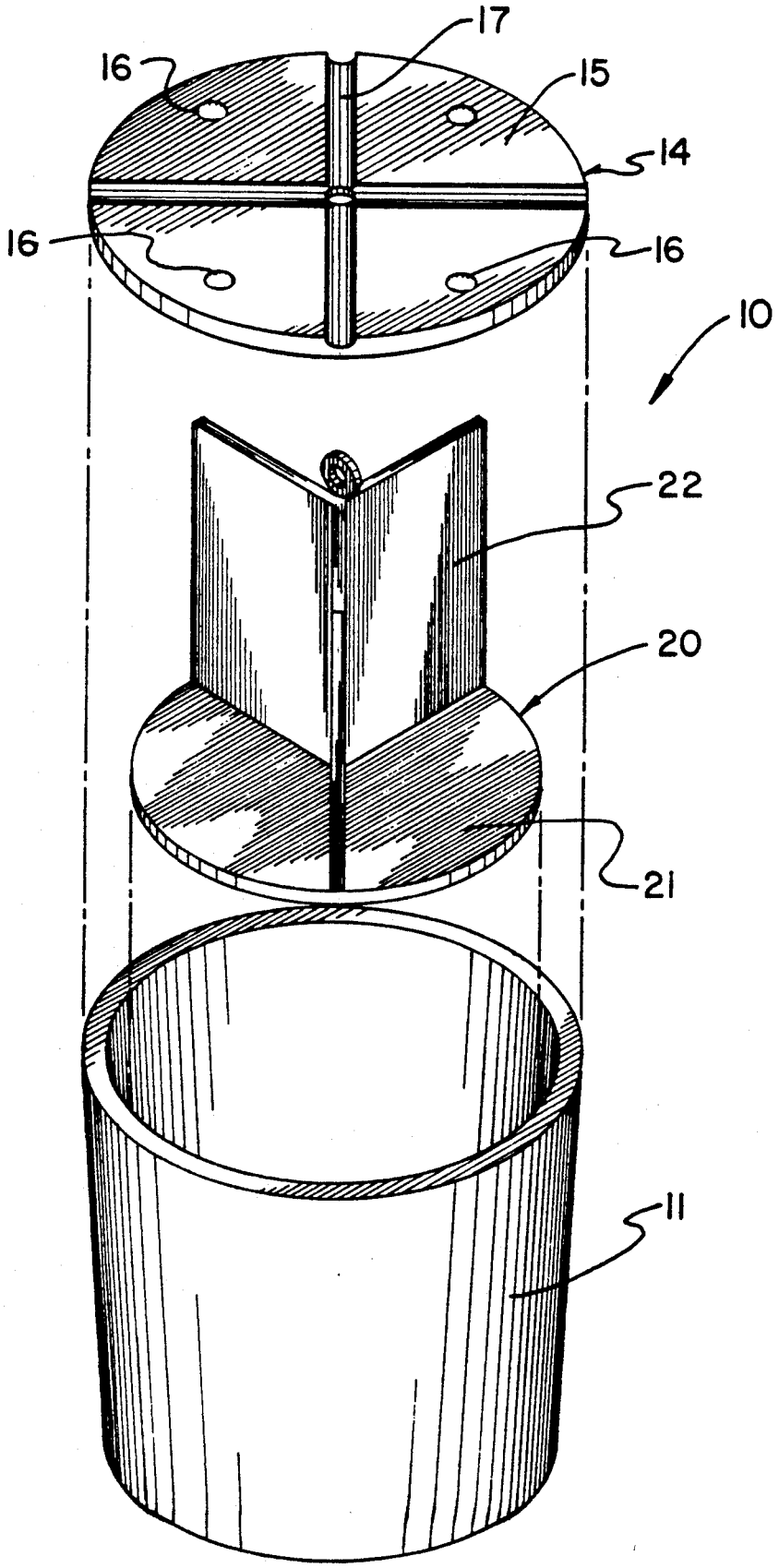
FIG. 1 is an isometric illustration of the instant invention.
Figure 2:
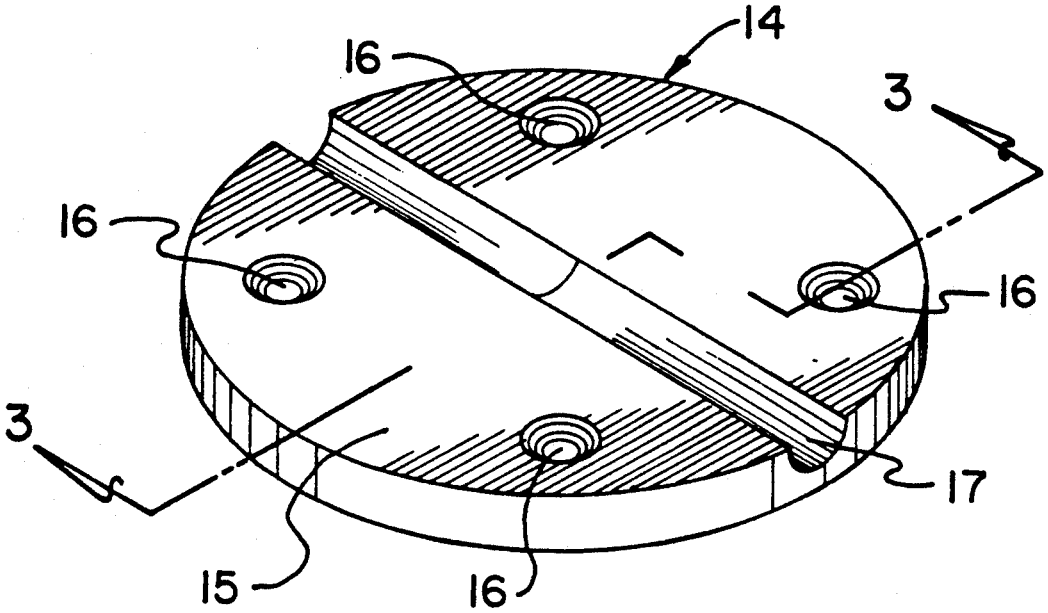
FIG. 2 is an isometric illustration of the lid structure of the invention.
Figure 3:
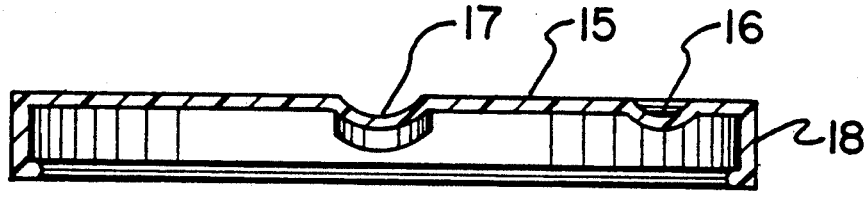
FIG. 3 is an orthographic view, taken along the lines 3—3 of FIG. 2 in the direction indicated by the arrows.
Figure 4:
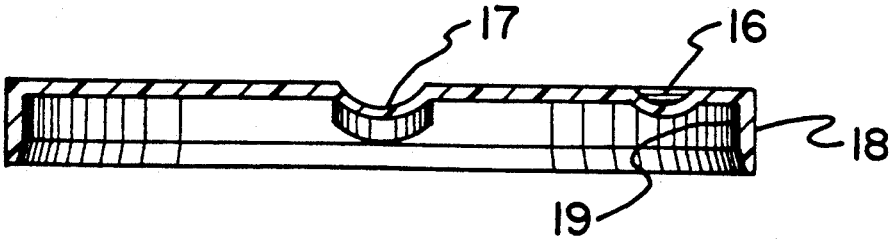
FIG. 4 is an orthographic cross-sectional illustration of the lid utilizing a magnetic inner skirt.

With reference now to the drawings, and in particular to FIGS. 1 to 11 thereof, a new and improved tool transport container apparatus embodying the principles and concepts of the present invention and generally designated by the reference numeral 10 will be described.

More specifically, the tool transport container apparatus 10 of the instant invention essentially comprises a container bucket 11 formed of a generally inverted conical configuration, including a container floor 12 and an upper annular rim 11*a*. A plurality of hemispherical projections 13 are integrally formed to a bottom surface of the container floor 12 extending downwardly therefrom and spaced apart at a predetermined spacing relative to one another. A shape retentive flexible lid 14 is arranged for securement about the upper annular rim and includes a lid top surface 15, with the lid top surface 15 including a plurality of hemispherical recesses 16 arranged and spaced apart the predetermined spacing to receive the projections in a stacking relationship of a plurality of containers, in a manner such as exemplified in FIG. 8. At least one drainage groove 17 is diametrically directed through the top surface of the lid 14 for drainage of water therefrom during transport of the organization. The lid 14 is formed with a cylindrical lid skirt 18, wherein as illustrated in the FIGS. 3 and 4, may be used alone or in cooperation with a magnetic liner 19 positioned to an interior surface of the lid skirt 18 for adherence to a ferrous container bucket 11.

The container includes a container cavity 11*b* to receive an insert 20 therewithin. The insert 20 includes an insert floor plate 21. The insert floor plate includes an insert wall 22 mounted thereon. The insert wall may be arranged to divide the container cavity within as many compartments as required as illustrated in the FIGS. 1 and 10 for example. For purposes of convenience, typically a single insert wall 22 orthogonally mounted diametrically relative to the floor plate 21 is adequate in the dividing of the container cavity.

Figure 5:
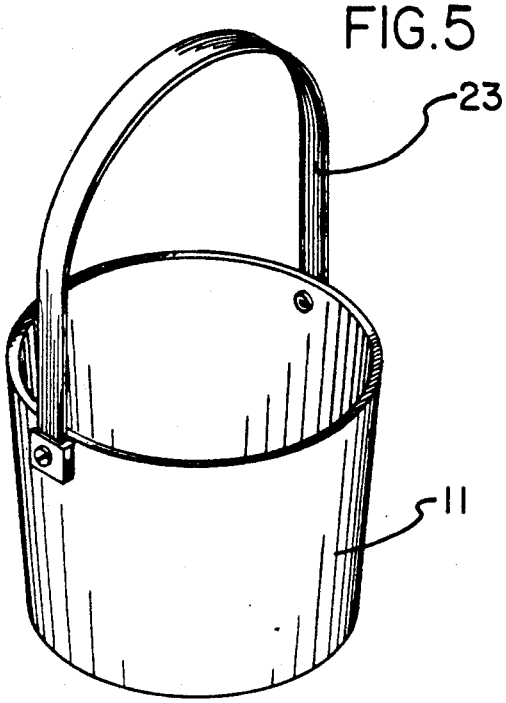
FIG. 5 is an isometric illustration of the container utilizing a carrying strap structure.
Figure 7:
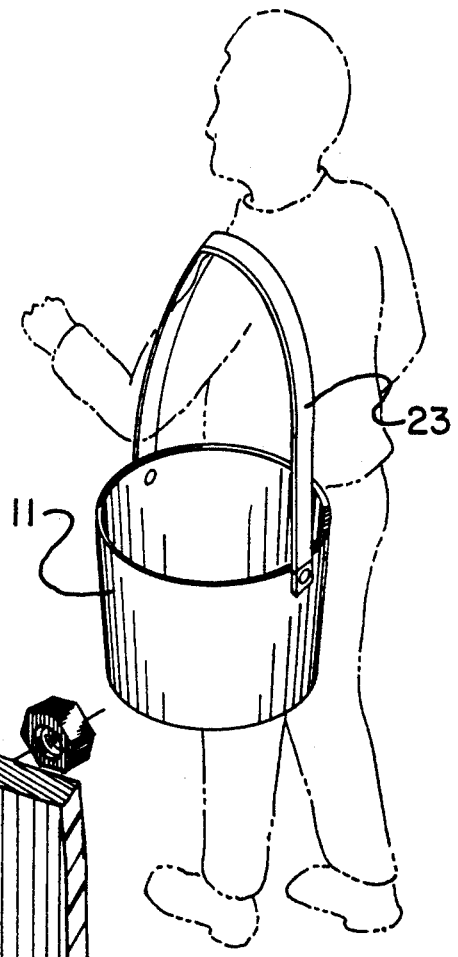
FIG. 7 is an isometric illustration of the container and its positioning about an individual.
Figure 6:
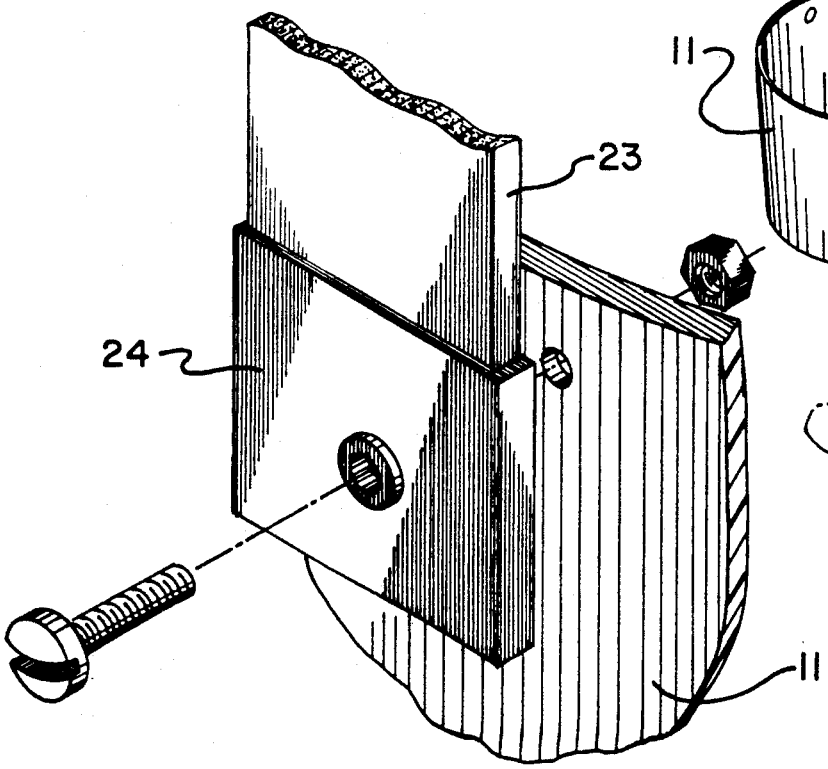
FIG. 6 is an enlarged isometric illustration of the carrying strap mounted to the container structure.

The FIGS. 5–7 illustrate the use of a flexible support strap 23 utilizing diametrically opposed anchor plates 24 mounting the strap to diametrically opposed positions about the annular rim of the container 11.

The FIG. 10 illustrates the use of an accessory support container 25 mounted to an upper distal end of the insert wall 22. The support container 25 includes a compartmented cavity 26 and a plurality of "L" shaped supports 27 mounted to a rear wall of the support container 25 of the "L" shaped supports 27 receiving the upper portion of the insert wall 22 between the "L" shaped supports 27 and the rear wall 25*a* of the support container 25.

The FIGS. 10, 10*a*, and 11 illustrate the use of a motion sensor 28 mounted to the floor 21 within the insert wall 22. The motion sensor 28 is formed as a housing, including a housing front wall 29 mounting a speaker 30 therethrough. The housing side wall 31 includes a battery door 32 removably mounted relative to the side wall for the positioning of a battery 33 within the housing. The battery 33 is in electrical communication with the speaker 30 and a switch member that is formed as a fluid capsule 34 containing a mercury fluid 35 therewithin. A first electrical wire 36 directs a first end of the battery 33 to the speaker 30. A second electrical wire 37 effects electrical communication with the speaker and a floor of the mercury filled capsule 34. A third electrical wire 38 connects a second end of the battery 33 to a top wall of the capsule 34, whereupon activation of the organization by positioning the battery within the housing, displacement of the mercury fluid within the capsule effects electrical communication between the third and second electrical wires 38 and 37 respectively to effect actuation of the audible alarm or speaker 30.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tool transport container apparatus, comprising, a first container bucket, the container bucket including an upper annular rim spaced from and parallel to a container floor, and a shape retentive flexible lid arranged for securement to the container bucket about the annular rim, and the container floor includes a plurality of spaced hemispherical projections extending downwardly relative to the floor to a bottom surface thereof, with the lid including a lid top surface, the lid top surface including a plurality of spaced hemispherical recesses directed into the top surface to permit reception of the projections of a container floor of a further container bucket within the recesses of the lid top surface to permit nesting of said further container bucket onto the lid, and at least one drainage groove diametrically directed through the lid top surface.

2. An apparatus as set forth in claim 1 wherein the first container bucket is formed of a ferrous material, and wherein the lid includes a cylindrical lid skirt, and a magnetic liner is secured to an interior surface of the lid skirt for magnetic adherence to the first container bucket.

3. An apparatus as set forth in claim 2 wherein the first container bucket includes a container cavity defined therewithin, and an insert, the insert received within the container cavity, the insert including an insert floor plate, the insert floor plate including an insert wall diametrically mounted to the insert floor plate directed diametrically relative to the insert floor plate.

4. An apparatus as set forth in claim 3 including a flexible support strap, the support strap mounted to the first container bucket at the upper annular rim.

5. An apparatus as set forth in claim 4 including an accessory support container, the accessory support container including a compartmented cavity therewithin, and further including an accessory support container rear wall, the accessory support container rear wall including a plurality of "L" shaped supports to receive the insert wall between the "L" shaped supports and the accessory support container rear wall.

6. An apparatus as set forth in claim 5 including a motion sensor mounted to the insert floor plate and received through the insert wall, the motion sensor including a sensor housing, the sensor housing including a housing front wall mounting an audio signal device, and the housing including a battery contained therewithin, and a fluid capsule positioned above the battery adjacent the audio signal device, and mercury fluid contained within the fluid capsule, and a first electrical wire directed from a first end of the battery to the audio signal device, and a second electrical wire directed from the audio signal device to a bottom wall of the fluid capsule, and a third electrical wire directed from a second end of the battery to a top wall of the capsule whereupon displacement of the mercury fluid within the capsule effects actuation of the audio signal device.

* * * * *